US008884729B2

(12) United States Patent
Lee

(10) Patent No.: US 8,884,729 B2
(45) Date of Patent: Nov. 11, 2014

(54) ELECTROMAGNETIC SWITCHING DEVICE

(71) Applicant: LSIS Co., Ltd., Anyang-si (KR)

(72) Inventor: Sang Jin Lee, Daegu (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 14/035,210

(22) Filed: Sep. 24, 2013

(65) Prior Publication Data

US 2014/0232494 A1 Aug. 21, 2014

(30) Foreign Application Priority Data

Feb. 18, 2013 (KR) ..... 20-2013-0001222 U

(51) Int. Cl.

| | |
|---|---|
| ***H01H 9/02*** | (2006.01) |
| ***H01H 13/04*** | (2006.01) |
| ***H01H 50/02*** | (2006.01) |
| ***H01H 50/04*** | (2006.01) |
| ***H01H 50/54*** | (2006.01) |

(52) U.S. Cl.

CPC ..... *H01H 9/02* (2013.01); *H01H 50/023* (2013.01); *H01H 50/041* (2013.01); *H01H 50/042* (2013.01); *H01H 50/045* (2013.01); *H01H 50/546* (2013.01)

USPC ..... 335/202; 335/78

(58) Field of Classification Search

USPC ..... 335/202

See application file for complete search history.

(56) References Cited

U.S. PATENT DOCUMENTS

| | | | | |
|---|---|---|---|---|
| 4,097,832 | A | 6/1978 | Ritzenthaler et al. | |
| 4,311,885 | A * | 1/1982 | Arthur | 200/16 C |
| 4,340,876 | A | 7/1982 | Dammert et al. | |
| 4,998,082 | A * | 3/1991 | Duimstra | 335/154 |
| 5,055,642 | A * | 10/1991 | Miyata | 200/293 |
| 5,216,396 | A * | 6/1993 | Stahly | 335/80 |
| 5,475,353 | A * | 12/1995 | Roshen et al. | 335/78 |
| 5,680,082 | A | 10/1997 | Stocklin | |
| 6,075,429 | A * | 6/2000 | Uotome et al. | 335/78 |
| 6,384,357 | B1 * | 5/2002 | Morrison | 200/520 |
| 6,392,179 | B1 * | 5/2002 | Schwarzbich | 200/520 |
| 6,847,000 | B1 * | 1/2005 | Marchini et al. | 200/402 |

(Continued)

FOREIGN PATENT DOCUMENTS

| | | |
|---|---|---|
| GB | 773852 | 5/1957 |
| JP | 48-11622 | 3/1973 |

(Continued)

OTHER PUBLICATIONS

Korean Intellectual Property Office Application Serial No. 20-2013-0001222, Office Action dated Jun. 5, 2014, 2 pages.

(Continued)

*Primary Examiner* — Elvin G. Enad
*Assistant Examiner* — Lisa Homza
(74) *Attorney, Agent, or Firm* — Lee, Hong, Degerman, Kang & Waimey

(57) ABSTRACT

Disclosed is an electromagnetic device. The electromagnetic switching device includes a housing having an opening, a top plate; side plates extending downward from the top plate; a bottom plate spaced apart from the top plate under the top plate; an opposite part which is one of the side plates facing the opening and coupled to the top and bottom plates, and a tolerance absorbing bar extending toward the opening.

7 Claims, 4 Drawing Sheets

(56) References Cited

U.S. PATENT DOCUMENTS

| | | | | |
|---|---|---|---|---|
| 6,903,638 | B2 * | 6/2005 | Nakamura et al. | 335/78 |
| 7,102,090 | B2 * | 9/2006 | Morisada | 200/296 |
| 7,283,026 | B2 * | 10/2007 | Nakamura et al. | 335/78 |
| 7,956,304 | B2 * | 6/2011 | Bacigalupe et al. | 200/334 |
| 7,986,204 | B2 * | 7/2011 | Mader et al. | 335/78 |
| 7,990,238 | B2 * | 8/2011 | Tan | 335/78 |
| 8,080,757 | B2 * | 12/2011 | Zuo | 200/548 |
| 8,164,246 | B2 * | 4/2012 | Jung et al. | 313/495 |
| 2005/0057332 | A1 * | 3/2005 | Nakamura et al. | 335/128 |
| 2007/0284998 | A1 * | 12/2007 | Lee et al. | 313/496 |
| 2008/0036360 | A1 * | 2/2008 | Kang et al. | 313/496 |
| 2008/0054792 | A1 * | 3/2008 | Lee | 313/496 |
| 2009/0129062 | A1 * | 5/2009 | Lee et al. | 362/97.3 |
| 2010/0182109 | A1 * | 7/2010 | Kuo | 335/78 |
| 2012/0092094 | A1 * | 4/2012 | Lee | 335/78 |
| 2013/0321108 | A1 * | 12/2013 | Lee | 335/192 |
| 2013/0335176 | A1 * | 12/2013 | Lee | 335/187 |

FOREIGN PATENT DOCUMENTS

| | | |
|---|---|---|
| JP | 56-165306 | 12/1981 |
| JP | 08-153433 | 6/1996 |
| JP | 08-336089 | 12/1996 |
| JP | 10-134692 | 5/1998 |
| JP | 2009-230921 | 10/2009 |
| KR | 10-1090504 | 12/2011 |

OTHER PUBLICATIONS

European Patent Office Application Serial No. 13184093.6, Search Report dated May 9, 2014, 10 pages.

Japan Patent Office Application Serial No. 2013-198031, Office Action dated May 13, 2014, 2 pages.

Korean Intellectual Property Office Application Serial No. 20-2013-00012222, Office Action dated Aug. 19, 2014, 2 pages.

* cited by examiner

ELECTROMAGNETIC SWITCHING DEVICE

CROSS-REFERENCE TO RELATED APPLICATIONS

Pursuant to 35 U.S.C. §119(a), this application claims the benefit of earlier date and right of priority to Korean Patent Application No. 20-2013-0001222, filed on Feb. 18, 2013, the contents of which is incorporated by reference herein in its entirety.

BACKGROUND

The embodiment relates to an electromagnetic switching device, and more particularly to an electromagnetic switching device which can be assembled at high assembly accuracy by absorbing coupling tolerance in the process of assembling the electromagnetic switching device An electromagnetic switching device is an electric switch device serving as a connection converter to switch on/off a main circuit according to tiny variation of input current. In the electromagnetic switching device, a contact point is moved by electromagnetic force so that current is applied or shut off.

FIGS. 1 and 2 are views showing an electromagnetic switching device according to the related art. The electromagnetic switching device includes a housing 10, and upper and lower assemblies 20 and 30 received in the housing 10.

The housing 10 includes top and bottom plates 11 and 13 having a substantially rectangular shape, and three side plates 12 interposed between the top and bottom plates 11 and 13. Since the housing 10 has only three side plates 12, an opening is formed at one side of the housing 10.

The upper assembly 20 includes a case 21 and an upper port 22 protruding from the case 21 to an outside.

The lower assembly 30 includes a case 31, a lower port 32 protruding from the case 31 to an outside, a coil 33 to which a current is applied through the lower port 32, a fixed core 34 included in the coil 33, a movable core 35 included in the fixed core 34, and a shaft 36 which performs a reciprocating motion together with the movable core 35.

Thus, the movable core 35 and the shaft 36 reciprocate up and down as power is intermittently supplied to the coil 33, so that a movable contact point coupled to the shaft 36 repeatedly makes contact with and is separated from a fixed contact point provided on the upper assembly 20.

According to a method of assembling the electromagnetic switching device of the related art, after the upper assembly 20 is coupled to the lower assembly 30 from the top of the lower assembly 30, the coupled upper and lower assemblies 20 and 30 are fitted into the housing 10, and then, epoxy is coated on an edge of the opening of the housing 10 to seal the housing 10.

In this assembling process, when an assembly tolerance occurs due to an increase in a height of the upper or lower assembly 20 or 30, the top surface of the case 21 of the upper assembly 20 pushes upward the top plate 11 of the housing 10, so that a gap is generated at the edge of the opening to be sealed.

Thus, the epoxy provided in the sealing process flows into the housing 10 through the gap, so that the failure rate is increased.

SUMMARY

The embodiment provides a structure capable of absorbing the assembly tolerance among a housing, an upper assembly and a lower assembly.

According to one embodiment, there is provided an electromagnetic switching device including: a housing including an opening; an upper assembly received in the housing; and a lower assembly received in the housing and coupled to a lower portion of the upper assembly, wherein the housing includes: a top plate; side plates extending downward from the top plate; a bottom plate coupled to a lower end of the side plates; an opening at one side of the housing; an opposite part which is one of the side plates facing the opening; and a tolerance absorbing bar located below the top plate and elastically deformable.

The tolerance absorbing bar may include one end coupled to the opposite part and an opposite end extending toward the opening.

The tolerance absorbing bar may include an elastically deformable cantilever.

The top plate, the bottom plate, the side plates and the tolerance absorbing bar may be integrated with each other.

The tolerance absorbing bar may include one end coupled to the top plate and an opposite end extending toward the opening.

A case of the upper assembly may include a pressing part pressed by the tolerance absorbing bar, and the pressing part may include an inclined surface gradually inclined downward toward the opposite part.

The pressing part may further include a horizontal surface horizontally extending from a front of the inclined surface.

The electromagnetic switching device may further include a protrusion part protruding upward from a front end of a case of the upper assembly.

According to the embodiment, the assembly tolerance, which may be caused during a process of assembling an electromagnetic switching device, may be absorbed, so that the failure rate may be reduced and the durability may be improved.

DETAILED DESCRIPTION OF THE EMBODIMENTS

Hereinafter, a configuration of an electromagnetic switching device according to the embodiment will be described with reference to accompanying drawings.

Figure 1:
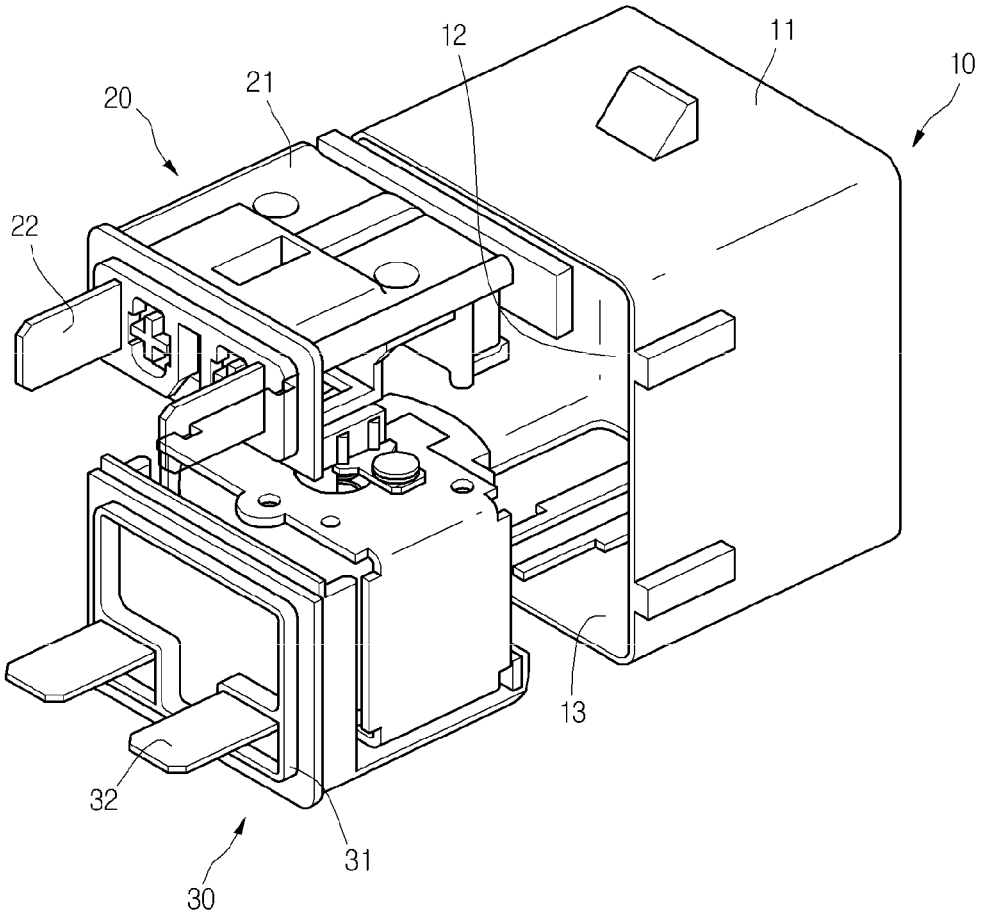
FIG.1 Prior Art
FIG. 1 is an exploded perspective view showing an electromagnetic switching device according to the related art.
Figure 2:
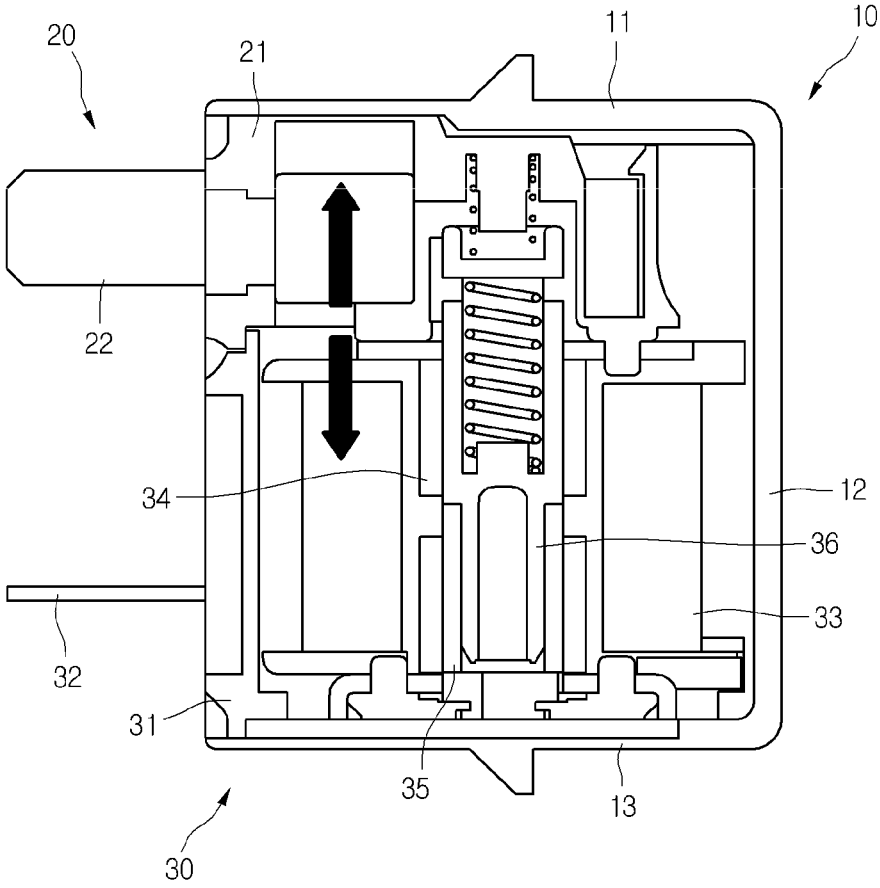
FIG.2 Prior Art
FIG. 2 is a side sectional view of the electromagnetic switching device of FIG. 1.
Figure 3:
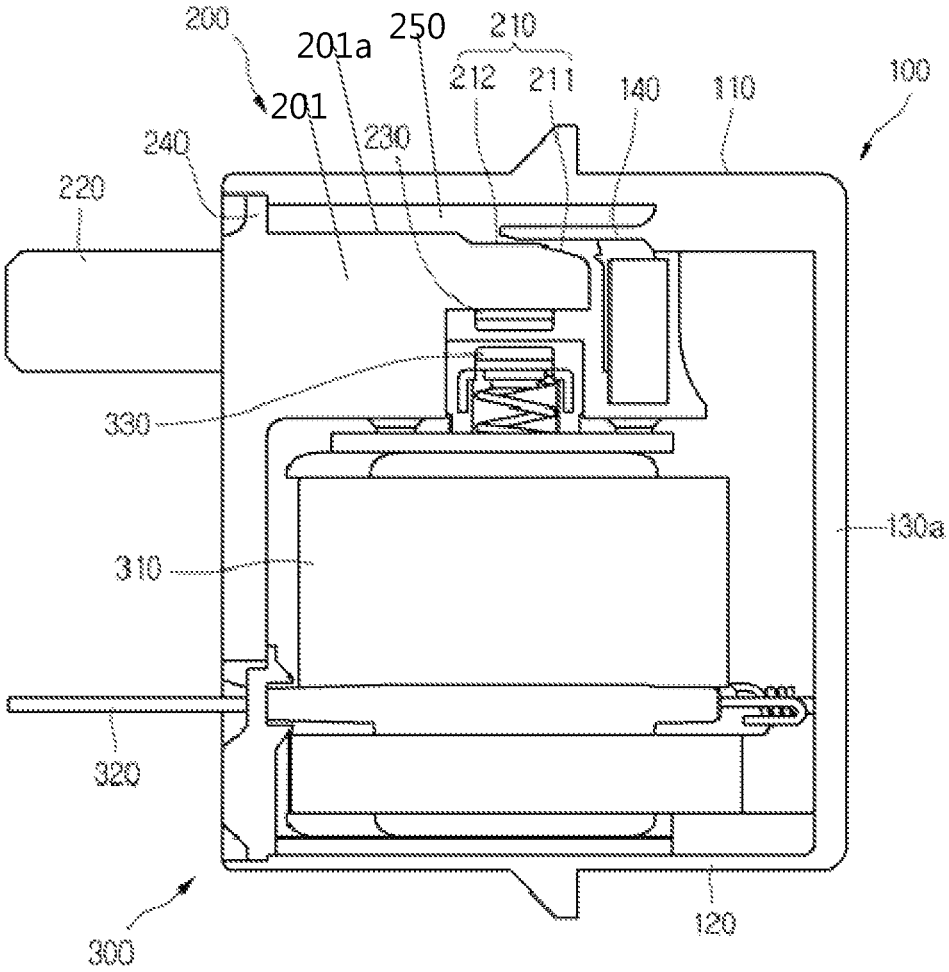
FIG. 3 is a perspective view showing the inside of an electromagnetic switching device according to the embodiment.
Figure 4:
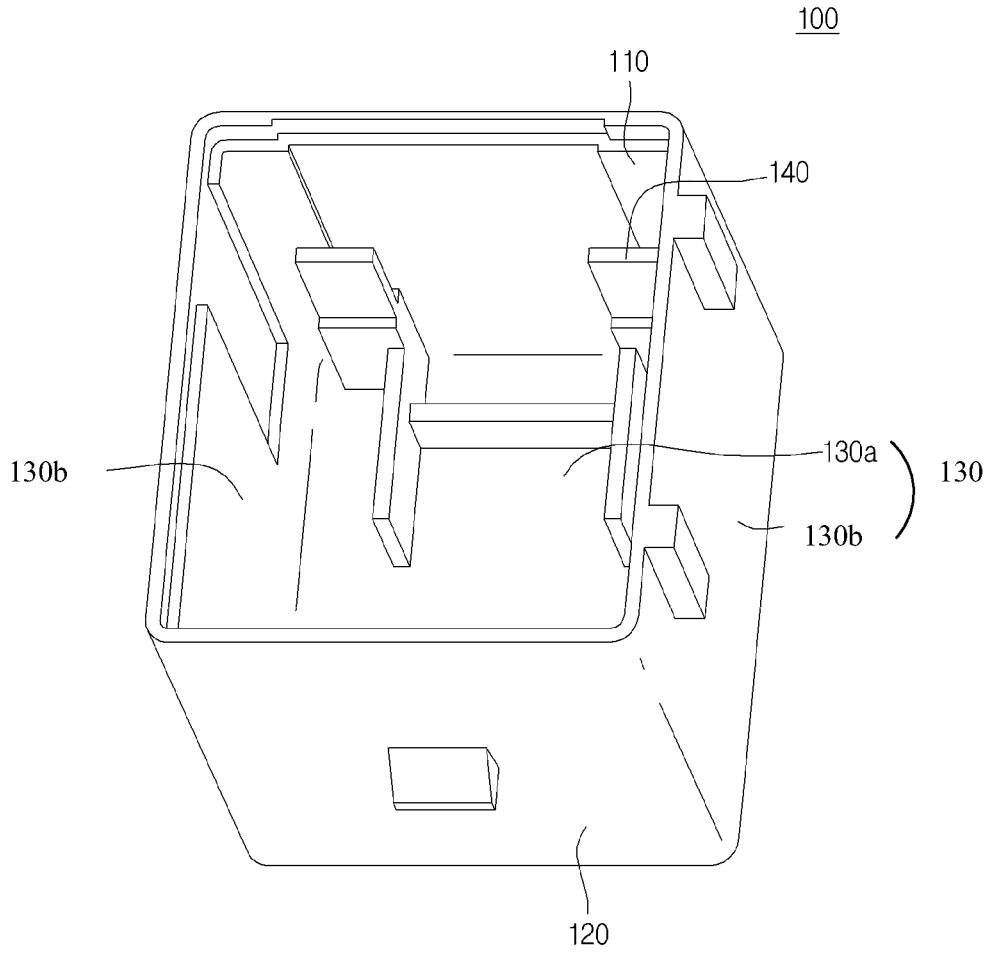
FIG. 4 is a perspective view showing a housing according to the embodiment.

FIG. 3 is a perspective view showing the inside of an electromagnetic switching device according to the embodiment. FIG. 4 is a perspective view showing a housing according to the embodiment.

An electromagnetic switching device according to the embodiment includes a housing 100, and upper and lower assemblies 200 and 300 disposed in the housing 100.

The housing 100 has a substantially rectangular-parallelepiped shape having an opening in one side surface.

Thus, the housing 100 includes a top plate 110 having a substantially rectangular shape, three side plates 130 that extend downward from an edge of the top plate 110, and a bottom plate 120 that is coupled to lower ends of the three side plates. The three side plates are formed by two side plates 130*b* and an opposite part 130*a*. The bottom plate has a shape corresponding to a shape of the top plate.

Among the three side plates 130 of the housing 100, the opposite part 130*a* is a side plate facing the opening.

A tolerance absorbing bar 140 is coupled to the opposite part 130*a*. The tolerance absorbing bar 140 may be a cantilever having a fixed rear and a free front end. The rear end of the tolerance absorbing bar 140 is coupled to the opposite part 130*a* and the front end of the tolerance absorbing bar 140 extends toward the opening. The tolerance absorbing bar 140 may be elastically deformable.

In the following description of the embodiment, a front direction refers to a direction toward the opening and a rear direction refers to an insertion direction of the upper 200 and lower 300 assemblies, which is a direction toward the opposite part 130*a*.

Meanwhile, the rear end of the tolerance absorbing bar 140 is not necessarily fixed only to the opposite part 130*a*, but may be coupled to all of the top plate 110 and the opposite part 130*a* or only to the top plate 100. In FIG. 3, the rear end of the tolerance absorbing bar 140 is fixed to portions protruding from all of the top plate 110 and the opposite part 130*a* of the housing 100.

In this case, if the portion coupled to the rear end of the tolerance absorbing bar 140 is toward the front direction, it may be understood that the rear end of the tolerance absorbing bar 140 is coupled to the opposite part 130*a*. If the portion coupled to the rear end of the tolerance absorbing bar 140 is toward a down direction, it may be understood that the rear end of the tolerance absorbing bar 140 is coupled to the top plate 110.

Thus, since the rear end of the tolerance absorbing bar 140 is fixed to a surface toward the front direction substantially parallel to the opposite part 130*a* in FIG. 3, it may be understood that the rear end of the tolerance absorbing bar 140 is fixed to the opposite part 130*a*.

The tolerance absorbing bar 140 may be formed integrally with the top plate 110, the side plate 130 and 130*a* and the bottom plate 120 and of an elastic deformable material such as plastic.

The upper assembly 200 includes a case 201 that has a top surface 201, an upper port 220 that protrudes toward an outside of the case, and several elements received in the case.

A pressing part 210, which is pressed downward by the tolerance absorbing bar 140, is provided at the top surface 201*a* of the case 201.

The pressing part 210 includes a horizontal surface 212 extending in a substantially horizontal direction and an inclined surface 211 provided at a rear end of the horizontal surface 212 and gradually inclined downward in the rear direction.

Due to the existence of the inclined surface 211, when the upper assembly 200 is pressed in the rear direction to move, the front end of the tolerance absorbing bar 140 slides on the inclined surface 211 so that the tolerance absorbing bar 140 may be elastically deformed to be bent upward.

The case 201 includes a protrusion 240 that protrudes upward from the front end of the case.

A space 250 is formed between the top plate 110 and the case 201 of the housing 100 at the rear of the protrusion 240.

Since an assembly tolerance is absorbed by the space 250, a gap in the opening that is caused by pressing the top plate 110 of the housing 100 upward due to the assembly tolerance may be prevented.

Meanwhile, a fixed contact point 230 is provided in the upper assembly 200 electrically connected to the upper port 220.

Hereinafter, a configuration of the lower assembly will be described.

The lower assembly includes a coil 310, a lower port 320 electrically connected to the coil 310, and a movable contact point 330. When electric power is supplied or shut off through the lower port 320, the movable contact point 330 moves up and down such that the movable contact point 330 repeatedly makes contact with and is separated from the fixed contact point 230.

Since the configuration and principle of the lower assembly for allowing the fixed contact point 230 to move up and down may correspond to the configuration and principle of a lower assembly of a conventional electromagnetic switching device, the detailed description thereof will be omitted.

Hereinafter, a method of assembling the electromagnetic switching device having the above configuration will be described.

First, after the upper assembly 200 is coupled to the lower assembly 300 from the top of the lower assembly 300, the upper and lower assemblies 200 and 300 are fitted into the housing 100. In this process, when the pressing part 210 of the upper assembly 200 inserted into the housing 100 through the opening, the inclined surface 211 first makes contact with the front end of the tolerance absorbing bar 140.

As the upper assembly 200 moves relatively in the rear direction to be inserted into the housing 100, the tolerance absorbing bar 140 slides on the inclined surface 211 to be placed on the horizontal surface 212.

In this process, since the tolerance absorbing bar 140 is elastically deformed upward, the tolerance absorbing bar 140 presses the upper assembly downward by a restoring force biasing the tolerance absorbing bar 140 to return to its original position.

Thus, even though an assembly tolerance occurs so that the height of the assembled upper assembly 200 becomes slightly higher, the tolerance is absorbed by the tolerance absorbing bar 140 so that the top plate 110 of the housing 100 may be prevented from being pressed and lifted upward.

Meanwhile, when the upper and lower assemblies 200 and 300 are completely pushed in the housing 100, the protrusion 240 formed at the front end of the upper assembly 200 may almost make contact with or may be slightly spaced apart from the front end of the upper plate 110 of the housing 100.

In this state, by injecting a sealing material such as epoxy into the edge of the opening of the housing 100, the upper and lower assemblies 200 and 300 and the housing 100 are sealed without forming a gap therebetween.

Although embodiments have been described with reference to a number of illustrative embodiments thereof, it should be understood that numerous other modifications and embodiments can be devised by those skilled in the art that will fall within the spirit and scope of the principles of this disclosure.

Therefore, the embodiments do not intend to limit the technical features of the disclosure but intend to explain the technical features of the disclosure and the technical features of the disclosure may not limited by the above embodiments.

More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electromagnetic switching device, comprising:

a housing including an opening;

an upper assembly received in the housing; and a lower assembly received in the housing and coupled to a lower portion of the upper assembly, wherein the housing comprises:

a top plate;

side plates extending downward from the top plate;

a bottom plate coupled to a lower end of the side plates;

an opening at one side of the housing;

an opposite part that is one of the side plates and faces the opening; and an elastically deformable tolerance absorbing bar located below the top plate, wherein the upper assembly comprises:

a case;

a protrusion that protrudes upward from a front end of the case; and a top surface of the case spaced apart from the top plate of the housing at a rear of the protrusion.

2. The electromagnetic switching device of claim 1, wherein the tolerance absorbing bar includes one end coupled to the opposite part and an opposite end extending toward the opening.

3. The electromagnetic switching device of claim 2, wherein the tolerance absorbing bar further includes an elastically deformable cantilever.

4. The electromagnetic switching device of claim 1, wherein the top plate, the bottom plate, the side plates and the tolerance absorbing bar are integrated with each other.

5. The electromagnetic switching device of claim 1, wherein the tolerance absorbing bar includes one end coupled to the top plate and an opposite end extending toward the opening.

6. The electromagnetic switching device of claim 1, wherein:

the case includes a pressing part pressed by the tolerance absorbing bar, and the pressing part includes an inclined surface gradually inclined downward toward the opposite part.

7. The electromagnetic switching device of claim 6, wherein the pressing part further includes a horizontal surface horizontally extending from a front of the inclined surface.

* * * * *